US011374348B2

(12) United States Patent
Stremlau et al.

(10) Patent No.: US 11,374,348 B2
(45) Date of Patent: Jun. 28, 2022

(54) MODULAR SYSTEM FOR PLUG CONNECTOR MODULES, PLUG CONNECTOR UNIT AND MODULAR HOUSING FRAMES FOR SAME

(71) Applicant: igus GmbH, Cologne (DE)

(72) Inventors: Christian Stremlau, Troisdorf (DE); Till Brinkman, Bergisch Gladbach (DE); Sebastian Griepenstroh, Luebbecke (DE); Romano Deimel, Diepenau (DE)

(73) Assignee: IGUS GMBH, Cologne (DE)

( * ) Notice: Subject to any disclaimer, the term of this patent is extended or adjusted under 35 U.S.C. 154(b) by 0 days.

(21) Appl. No.: 17/135,386

(22) Filed: Dec. 28, 2020

(65) Prior Publication Data

US 2021/0119372 A1 Apr. 22, 2021

Related U.S. Application Data

(63) Continuation of application No. 16/499,543, filed as application No. PCT/EP2018/058502 on Apr. 3, 2018, now abandoned.

(30) Foreign Application Priority Data

Mar. 31, 2017 (DE) ..... 20 2017 101 914.4

(51) Int. Cl.
*H01R 13/518* (2006.01)
*H01R 13/514* (2006.01)

(52) U.S. Cl.
CPC ..... *H01R 13/518* (2013.01); *H01R 13/514* (2013.01)

(58) Field of Classification Search
CPC ..... H01R 13/518; H01R 13/514
See application file for complete search history.

(56) References Cited

U.S. PATENT DOCUMENTS 3,072,340 A * 1/1963 Dean ..... H01R 13/514 439/291
3,289,145 A 11/1966 Ruehlemann et al.
(Continued)

FOREIGN PATENT DOCUMENTS

DE 3014755 10/1981
DE 19707120 6/1998
(Continued)

OTHER PUBLICATIONS

Office Action from related Japanese Appln. No. 2019-553522, dated Jan. 4, 2022. English translation attached.
(Continued)

*Primary Examiner* — Abdullah A Riyami
*Assistant Examiner* — Nader J Alhawamdeh
(74) *Attorney, Agent, or Firm* — Grossman, Tucker, Perreault & Pfleger, PLLC

(57) ABSTRACT

A modular system for plug connector modules for producing plug connector units, and to at least one first housing frame for receiving a plurality of plug connector modules within the housing frame. Each housing frame has two parallel longitudinal side walls, which define the frame width of the housing frame, and perpendicularly thereto two parallel narrow side walls, which define the frame height of the housing frame. According to the invention: i) the frame width is an integer multiple of the frame height, optionally plus joint play; ii) the longitudinal side walls and the narrow side walls have connection elements for form-fitting connection, wherein in each case a connection element of a longitudinal side wall corresponds to a connection element of a narrow side wall; and iii) on each longitudinal side wall a plurality of connection elements are arranged at a grid distance which corresponds to the frame height, optionally plus joint play, along the frame width. A plurality of housing
(Continued)

frames can thus be connected to one another in a modular manner on the basis of their connection elements so as to form a plug connector unit.

38 Claims, 4 Drawing Sheets

(56) References Cited

U.S. PATENT DOCUMENTS

| | | | | |
|---|---|---|---|---|
| 4,425,018 | A | 1/1984 | Stenz | |
| 5,295,870 | A | 3/1994 | Rei et al. | |
| 6,004,162 | A | 12/1999 | Harting et al. | |
| 6,913,487 | B2 | 7/2005 | Beneke et al. | |
| 6,962,511 | B2 * | 11/2005 | Gutierrez | H01R 13/7172 439/490 |
| 2011/0287661 | A1 * | 11/2011 | Khemakhem | H01R 13/518 439/578 |
| 2014/0357095 | A1 | 12/2014 | Kute | |
| 2015/0280351 | A1 | 10/2015 | Bertsch | |
| 2017/0237209 | A1 * | 8/2017 | Loetkemann | H01R 43/00 439/540.1 |
| 2020/0044381 | A1 * | 2/2020 | Stremlau | H01R 13/518 |

FOREIGN PATENT DOCUMENTS

| | | |
|---|---|---|
| EP | 0170455 | 2/1986 |
| EP | 1309040 | 5/2003 |
| EP | 1398853 | 3/2004 |
| WO | 2014/072005 | 5/2014 |

OTHER PUBLICATIONS

Search report from corresponding German Appln. No. 20 2017 101 483.5, dated Nov. 14, 2017.

Search Report from corresponding German Appln. No. 20 2017 101 914.4, dated Feb. 6, 2018.

English translation of International Search Report from corresponding PCT Appln No. PCT/EP2018/058502, dated Jun. 5, 2018.

English translation of International Preliminary Report on Patentability from corresponding PCT Appln No. PCT/EP2018/058502, dated Jun. 4, 2019.

Office Action and Search Report from related Chinese Appln. No 201880032062.7, dated Sep. 16, 2020. English translation attached.

* cited by examiner

MODULAR SYSTEM FOR PLUG CONNECTOR MODULES, PLUG CONNECTOR UNIT AND MODULAR HOUSING FRAMES FOR SAME

CROSS-REFERENCE TO RELATED APPLICATIONS

The present application is a continuation application of U.S. non-provisional patent application Ser. No. 16/499,543, filed Sep. 30, 2019, now abandoned, which is a U.S. national stage (371) application of PCT application serial no. PCT/EP2018/058502 filed Apr. 3, 2018, which claims priority to German patent application serial no. 20 2017 101 914.4, filed Mar. 31, 2017, which are all incorporated by reference herein.

FIELD

The invention generally concerns a modular construction system for producing plug connector units on the basis of different plug connector modules, in particular rectangular plug connector units for different kinds of transmission, and a corresponding plug connector unit. The invention especially concerns a modular housing frame for same.

The invention concerns in particular the field of electric plug connectors, that is to say plug connectors for electric power and/or electric signals.

BACKGROUND

A modular system of the general kind set forth having a plurality of very different plug connector modules is offered for example by HARTING Deutschland GmbH & Co. KG, D-32427 Minden, under the trade name "Han-Modular® system". That system is described for example in the catalog "HARTING Selection Guide-Han-Modular® Steckverbinder" (Version 3, 2016-211-21). Other manufacturers also offer comparable systems. They make it possible to connect different plug connector modules to form a unit.

That is effected for example in the HARTING system on the basis of a so-called holding frame, in particular an articulated frame having a plurality of identical receiving means for receiving a plurality of plug connector modules in the frame. The frame has two parallel longitudinal side walls which define the frame width and two parallel narrow side walls perpendicular thereto, which define the height of the housing frame. In that system the narrow side walls have rotary articulations which serve for pivotably opening and closing the longitudinal side walls from and into a locking position respectively. Patent DE 197 07 120 C1 describes such an articulated frame and its cooperation with plug connector modules. The articulated frame permits mechanical connection of the plug connector modules which are designed with suitable modular fixing means.

An example of a suitable plug connector module is shown in FIG. 3 of DE 197 07 120 C1, others are described for example in patent EP 1 398 853 B1.

With a system of the general kind set forth a plurality of different plug connector modules for different transmission media like current, signals, operating media and so forth can be combined selectively in a plug connector unit. Bringing different plug connector modules together in a unit shortens installation and maintenance times and reduces the amount of space needed.

As can be seen from the above-mentioned catalog and from EP 1 398 853 B1 (see FIG. 4), in the previously known system after assembly with the desired plug connector modules, a respective articulated frame is provided with a separate plug or attachment housing which serves as the actual housing of the plug connector unit and for example has the cable support sleeves or fixings for attachment.

A further system of the general kind set forth from another manufacturer and further plug connector modules are described in EP 1 309 040 B1 (FIG. 5). FIG. 6 of EP 1 309 040 B1 also discloses the principle whereby a number of identical housing frames are arranged in mutually juxtaposed relationship in a direction in which they extend in the form of a unit, wherein each of the housing frames receives only one respective individual plug connector module.

In addition, as described for example in U.S. Pat. No. 3,289,145 A or laid-open application DE 30 14 755 A1, systems which are not of the general kind set forth are known, in which plug and socket insulating bodies for electrical contacting are arranged in a row and connected together to form a unit by connecting means provided directly on the plugs and sockets respectively. In that case there is no separate holding frame and no actual plug or attachment housing. That alternative modular principle for plug and socket bodies as such allows for only slight mechanical loadings, it permits only in part the combination of various transmission media and is rather unsuitable for many industrial applications. In addition, the sealing classes required in industry can scarcely be implemented therewith.

In addition, US 2011/0287661 A1 proposes housing frames which can be connected together and which are intended for mounting specific coaxial through-connection sleeves in the frame structure of a rack. That approach is also not of the general kind set forth or relates to a different field, as the frames only involve assembly aids for producing a rack, but not housing portions of actual plug connector units, that is to say units which can be connected in the form of a plug and a counterpart plug.

The modular system of the general kind as set forth in the opening part of this specification in contrast has proved its worth in practice and offers many advantages. However, a large number of different components are required, for example differing widths of articulated frames and a multiplicity of plug, socket or attachment housings.

A first object of the present invention is to increase the modularity of the system, wherein preferably the aim is to permit at the same time a reduction in the overall number needed of components or constituent parts of the modular system. The plug connector unit constructed therewith is intended to be suitable in particular for electrical plug connections in industrial applications.

The modular system of the general kind set forth for plug connector modules, in particular for producing rectangular plug connectors (called rectangular connectors in short-form), includes a number of housing frames, but at any event at least one first housing frame having a plurality of identical receiving means for receiving a plurality of plug connector modules in the interior of the housing frame, wherein the housing frame has two parallel longitudinal side walls which define the frame width of the housing frame and perpendicularly thereto two parallel narrow side walls which define the frame height of the housing frame.

SUMMARY

In accordance with the invention in this first type of housing frame it is provided that:

the frame width is substantially an integral multiple of the frame height, more specifically exactly an integral multiple plus a first joint play (excluding production tolerance), wherein that play is intentionally allowed for as a predetermined joint gap dimension;

both longitudinal side walls and both narrow side walls, that is to say all side walls, respectively have connecting elements, in particular for releasable connection by means of the outward sides and preferably for positively locking connection or fixing, wherein a respective connecting element of a longitudinal side wall corresponds to a connecting element of a narrow side wall or both are of a configuration adapted for the cooperation for the purposes of fixing in another housing frame; and arranged at each longitudinal side wall are at least two connecting elements in mutually space relationship in a grid spacing, wherein said grid spacing measured along the frame width substantially corresponds to the frame height, that is to say exactly the frame height of the housing frame plus a second predetermined joint play (excluding manufacturing tolerance).

The foregoing combination of features makes it possible for a plurality of housing frames—possibly also identical ones of the first type—to be connected together in modular mechanical relationship by means of their connecting elements in order to form a plug connector unit.

In that respect the first type of housing frame with quasi N-times frame width in relation to the frame height selected as the base unit represents a base component or a housing base module which enlarges the modularity of the connector system so-to-speak on the housing level by a further second stage. On the one hand the housing frames in that case themselves, individually or with further housing frames serve as the actual housing for receiving per se known plug connector modules which so-to-speak represent the first module stage. Those plug connector modules substantially comprise a modular insulating body and the electrical contacts or other media connectors which the insulating body holds in a predefined position. In addition, the number of required components for producing housings, in particular rectangular connector housings, is reduced by a low number of housing frames which cooperate in the modular structure (in the form of modular components). It is inter alia no longer necessary, in order to have a large number of connector sizes, to stock respectively correspondingly suitably dimensioned holding frames, plug housings, socket housings, attachment housings and so forth.

A core aspect in this respect is the dimensioning which matches in grid-like relationship in the two directions of extent which are perpendicular to the structural depth of the housing frame, that is to say in respect of width and height. In those two perpendicular directions of the connecting or assembly plane (perpendicular to the structural depth) the dimensions of the longitudinal side and the narrow side are selected to be in a modulo N side ratio suitable for modularity. In other words, the dimension in the direction in which the longitudinal side extends—if the slight joint play is disregarded—is always N-times the dimension in the direction in which the narrow side extends, wherein N represents a whole number, in particular of between 1 and 4, preferably with $2<N<4$.

A further core aspect is the grid dimension in accordance with which the connectors are arranged in modularly matching relationship so that a plurality of housing frames can be selectively assembled like components of a modular system. In that respect, at the narrow side walls, it is possible to provide at least one connecting element or only one connecting element, while provided at the long side walls there are always at least two connecting elements, at the spacing of the grid relationship.

By assembling a plurality of housing frames, it is possible to form a plug connector unit which as a plug can be connected in one step to a further plug connector unit, in particular a plug connector unit which is similarly fitted together from a plurality of housing frames, as a counterpart plug, and can be released therefrom.

Both in regard to the dimensioning of the side walls and also determining the grid size of the connecting elements a respective suitable joint play should be allowed for, which permits easy assembly in any direction and takes account of manufacturing tolerances and possibly also slight deformation of the housing frames. That facilitates the assembly of plug connector units from individual housing frames. The first joint play for the N-times dimensioning of the longitudinal sides can be identical to the second joint play in the grid relationship. Both respectively amount to only a very small proportion, in particular $<<5\%$, preferably $<3\%$, of the dimensioning in the direction in which the narrow side extends (perpendicularly to the depth). The first and the second joint plays can be for example some tenths of a millimeter to a few millimeters, depending on the respective dimensioning of the narrow side in the direction in which the assembly plane extends. In that respect the joint play is respectively set to be sufficiently small to ensure a firm fit or connection of the interconnected housing frames. Fixing of the housing frames should be effected substantially without relative play.

The modular housing frames in accordance with the invention in that case combine at least substantially the function of the previously known articulated frames with the function of the plug, socket or attachment housings receiving same, in a modular configuration.

The or each housing frame can be of a one-part structure or preferably can be of a multi-part structure or composition. The housing frame can be composed of two main parts. In one embodiment the housing frame has three main parts, in particular a frame-shaped front part which itself or by virtue of a holding frame forms the receiving means for individual plug connector modules, and two cooperating shell-like rear parts which, in particular in the direction of the depth, can be connected to the front part and to each other perpendicularly thereto. Thus inter alia cable assembly can be facilitated and possibly a clamping action on an elastic strain relief means can be achieved. For that purpose in particular, an elastic strain relief device can be provided in the interior between the cable pass-through openings and the receiving means for the plug connector modules. A strain relief means can alternatively be implemented with only one rear-side main part.

A further aspect worth mentioning is the configuration with connectors at all four outward sides of the housing frame, that is to say at each side wall. That permits a modular assembly in both directions of extent perpendicularly to the frame depth or the plug connection direction (in the assembly plane). That permits an overall sizing, which can be freely selected in both dimensions, in respect of the modular-structure plug connector unit.

In the case of the first base component or in the case of the housing frame of the first type the frame width can be in particular exactly double (2-times dimension) the frame height plus joint play.

In addition, as a second component, there can be provided at least one housing frame of a second type which represents the smallest unit or the smallest component of the frame modular system. That housing frame has at least two identical receiving means for fitting a plurality of plug connector modules in the interior of the housing frame, for example by positively locking fixing.

According to the invention, in this case also, similarly to the first type, in the second type of housing frame, it is provided that:

the frame width is equal to the frame height, that is to say N-times with N=1; and all side walls respectively have at least one and possibly a plurality of connecting elements, in particular for positively locking connection, wherein a connecting element of a side wall corresponds to a connecting element of the adjoining side wall, and in particular also respectively corresponds to a connecting element of the longitudinal or narrow side wall of the first housing frame.

Accordingly, a plurality of second housing frames can be modularly connected by means of their connecting elements to at least one further housing frame, in particular of the first type, to form a plug connector unit.

The correspondence of the connecting elements is to be interpreted generally in the present case. Mutually corresponding connecting elements can cooperate directly in mutually matching relationship or can be implemented for fixing purposes by a separate further connecting element which is designed in matching relationship with the two corresponding connecting elements.

A particularly simple embodiment of the modularly expanded system for plug connector units comprises only the first above-mentioned type of housing frame or only the two above-mentioned types of housing frame and possibly additional components which are compatible therewith and which themselves do not receive any plug connector modules, in particular suitable covers or rear-side closures and for example mounting plates, mounting elements, plug locking means and so forth. At least one separate connecting element which can be used in modular form can also belong to the modular system.

With just one housing frame type as described hereinbefore it is already possible to construct unitary plug connectors involving an overall sizing which can be relatively freely selected in both directions of extent.

In particular with both the above-mentioned types of housing frame it is possible to construct unitary plug connectors with a relatively freely selectable overall dimension in both directions of extent.

Provided on each type of housing frame, in particular both on the first type of housing frame and also on the second type, there are provided connecting elements which respectively correspond in pair-wise relationship or which are suitable for mutual cooperation, preferably for producing a positively locking connection. In that respect, basically any kind of positively locking and/or force-locking connector is suitable, which provides a mechanically fixed connection in the main plane of the side walls and a minimum strength in relation to tensile force perpendicularly thereto. Strength in the plug-in direction is significant for actuation of the plug connection. A minimum strength in relation to tensile force can possible be supplemented by further components like for example mounting plates, covers or the like in relation to the required fixing.

In a preferred development it is provided that all but at least a part of the connecting elements are designed for positively locking connection. Corresponding connecting elements can be in particular identical or also of a pair-wise complementary or conjugate configuration.

The connecting elements are preferably provided externally on or externally in the side walls. In principle all suitable kinds of connecting elements for positively locking and/or force-locking, in particular for releasable force-locking connection are considered, for example knobs which cooperate in plugging relationship in complementary fashion with openings or pins with holes, press-stud connectors with undercut configurations, clip connectors with latching hooks and latching edges, and so forth.

Preferably a component part of the housing frame is connecting elements in the form of recesses externally in the side walls, which enhances modularity and avoids troublesome edges, projections or the like at exposed outward sides.

Particularly preferably therefore there are provided additional separate connecting elements which cooperate with the recess-like connecting elements of the side walls. That enhances modularity and facilitates release of an individual housing frame from a plug connector unit which has already been assembled or finally fitted, that is to say for repair or maintenance.

In a simple particularly preferred embodiment some and preferably all connecting elements are in the form of grooves extending in the direction of the depth of the housing frame or perpendicularly to the assembly plane, with a cross-section which is suitable for a tongue-and-groove connection, for example T-shaped, of a dovetail shape or the like, in the side walls.

In particular if all connecting elements are in the form of grooves it is then possible to provide so-to-speak as tongues separate further connecting elements in the form of connecting tongues for connecting the housing frames by means of the grooves.

The connecting elements can be in particular of the cross-section for a dovetail connection, wherein in particular the connecting tongues are of a cross-section in the configuration of a double dovetail, with oppositely directed V-shaped wedge configurations.

In a preferred configuration, for cooperation with the connecting elements of the housing frames, there are provided suitable separate connecting tongues for making a tongue-and-groove connection. They are preferably of the cross-section for a dovetail connection.

Irrespective thereof separate connectors are preferred, which positively lockingly cooperate with the connecting elements of the housing frames.

The connectors or connecting tongues preferably have two latching tongues of mirror-image symmetrical configuration for latching with the housing frames so that they are latchable in both orientations. For fixing to external components the separate connectors or connecting tongues in the main body preferably have two screw holes, preferably with countersunk screw head at at least one main side.

When using grooves for making a tongue-and-groove connection it can also be provided that they are of a blind hole-like configuration in the direction of the depth of the housing frame or perpendicularly to the assembly plane, which inter alia permits arresting of the tongue in a desired position. For making a stable connection the grooves, preferably extending from the rear side, should extend over at least 33% of the depth of the housing frame.

For installation of per se known plug connector modules a per se known holding frame can be mounted in the housing frames. For the installation of per se known plug connector modules it can alternatively be provided that first and second positively locking recesses are respectively provided in opposite relationship in respect of each receiving means at both inward sides of the longitudinal side walls, which recesses cooperate for latching purposes with counterpart means of a plug connector module. Thus, per se, known plug connector modules can be arrested directly in the housing frame and oriented therein without requiring a further intermediate frame like for example the usual known articulated frame.

For closure and possibly also for sealing pass-through of the lines, as an alternative to two rear parts it is also possible to provide at the rear side of the housing frame preferably a respective suitably dimensioned cover, cable outlets with cable pass-through support sleeves are preferred in that case. Preferably the rear parts or the cover at the same time secure the separate or integrated connecting elements in the direction of the depth or in the plug-in connection.

The invention makes it possible in particular for two plug connector units which are substantially composed of housing frames (and conventional plug connector modules), that is to say without a respective further plug housing surrounding the housing frames or the like, to cooperate for plug connection of the plug connector modules. The two plug connector units serving as the plug and the counterpart plug can in that respect be composed in particular by means of identical housing frames.

The housing frames can be made from plastic, in particular a polycarbonate or fiber-reinforced plastic, preferably using injection molding, whereby additional electrical insulation is achieved at the same time. If an EMV shielding of the plug connector unit is required that can be achieved for example by suitable coating processes.

Naturally the housing frames can be made in part or completely from metal, depending on the respective requirements. In the case of housing frames of metal manufacture can be considered in particular using the pressure die casting process, for example using aluminum, zinc or a suitable alloy, in particular with aluminum and/or zinc, as the housing frames are made up from one or more shaped parts. Metal housing frames allow protective grounding or better signal integrity due to inherently better shielding. It is possible to provide in the interior of the metal housing frame a connection or a terminal for connecting the housing frame to a PE protective conductor.

As additional components it is possible to provide in particular separate assembly parts, in particular assembly angle members and/or assembly plates, which cooperate with the connecting elements of the side walls to fix the plug connector unit to the respective connecting location like a machine part, a switch cabinet or the like. Additional components are in principle required only for those functions which the housing frames or suitable plug connector modules cannot themselves implement.

It is possible to provide for example locking parts or locking means which can be fixed to the housing frames, like locking loops or the like, for securing two connected plug connector units. For mechanical locking of the plug connection it is possible to provide 1-loop or 2-loop locking devices, for example in accordance with the Han-Easy Lock® principle (see the above-mentioned catalog), toggle lever locking arrangements or however screw locking arrangements, bayonet locking arrangements and so forth. The cooperating locking components can be provided on attachment or assembly parts. Suitably adapted locking components for example locking loops can however also be mounted directly to the connecting elements of the housing frames. Any possibly desired locking means can also be mounted in modular relationship to a plug connector unit comprising housing frames.

Preferably each housing frame which is provided as a base component or the first type of housing frame has an even number (2×n, with n being a whole number) of identical receiving means for up to 2n plug connector modules, in particular four, six or eight receiving means, for fixing plug connector modules. In that case the receiving means can be in particular of a matching configuration for plug connector modules comprising the above-mentioned "Han-Modular® system", which provides 50 different modules for different transmission media and involving different connecting procedures.

The optional housing frame of the second type can have in particular precisely two receiving means for a plug connector module, in particular half the number in comparison with the housing frame of the first type.

The receiving means are preferably so arranged that fitted plug connector modules lie with their main extent transversely relative to the longitudinal sides of the housing frame. The dimension in the direction in which the width or the longitudinal sides extend therefore preferably scales with the dimension of the narrow sides of the plug connector modules, that is to say the plug connector modules preferably lie with their longitudinal side parallel to the narrow side of the housing frame.

Besides the modular system the invention naturally also concerns the individual housing frame as such as this first permits the second stage in modularity (so-to-speak on the "housing level") in the system which is already modular. Each housing frame in that case has two identical receiving means for a respective plug connector module in the interior of the housing frame, two parallel side walls defining the frame width and perpendicularly thereto two parallel side walls defining the frame height.

The modular housing frame in accordance with the invention is distinguished in that:

- the frame width is substantially N-times the frame height, possibly plus joint play, with N being a whole number, in particular between 1 and 8, preferably with $1<N<4$, particularly preferably $2<N<4$;
- all side walls have connecting elements, in particular for positively locking connection, wherein a respective connecting element of a side wall corresponds to a connecting element of a side wall perpendicular thereto; and
- the connecting elements are arranged relative to each other in accordance with a grid distance in such a way that a plurality of housing frames can be connected together by means of their connecting elements in modular relationship to form a plug connector unit.

The grid distance can consist of double the distance relative to the boundary surface of the adjoining side wall. More specifically that applies when only one respective connecting element is arranged centrally in the side wall which defines the frame height. That can apply in particular to the smallest housing frame and/or the housing frame provided as a base unit or base module. In the case of the next larger frame component or in the case of a longitudinal side wall with two connecting elements the grid distance then corresponds to the distance between two adjacent connecting elements at the longitudinal side wall.

The invention also concerns a plug connector unit including a plurality of plug connector modules for lines like cables, hoses or the like, possibly also for different transmission media, in particular for electric lines, wherein said unit is composed of at least two housing frames according to one of the foregoing embodiments. Accordingly, the or all plug connector modules are respectively received in one of the housing frames and the housing frames are fixed to each other by means of their connecting elements and joined to form a unit. In that case each plug connector unit can selectively represent either a plug or a counterpart plug, depending on the respective choice of the installed plug connector module.

The invention also concerns the use of housing frames according to one of the foregoing embodiments for the production of plug connector units, in particular rectangular connectors, for lines, in particular electric lines, but also for optical, liquid, gaseous or other transmission media.

BRIEF DESCRIPTION OF THE DRAWINGS

Further advantageous features and actions of the invention are described in greater detail hereinafter without limitation in respect of the generality of the foregoing description, by means of two embodiments by way of example with reference to the accompanying drawings in which:

FIGS. 6-7A, 7B show an exploded view (FIG. 6) and an assembled view of a housing frame as a plug (FIG. 7A) and as a counterpart plug (FIG. 7B) according to a further embodiment, each as a perspective view;

DETAILED DESCRIPTION

In all the drawings identical references denote identical features or features of an equivalent nature or effect. For the sake of simplicity many features which remain the same are not identified repeatedly.

Figure 1:
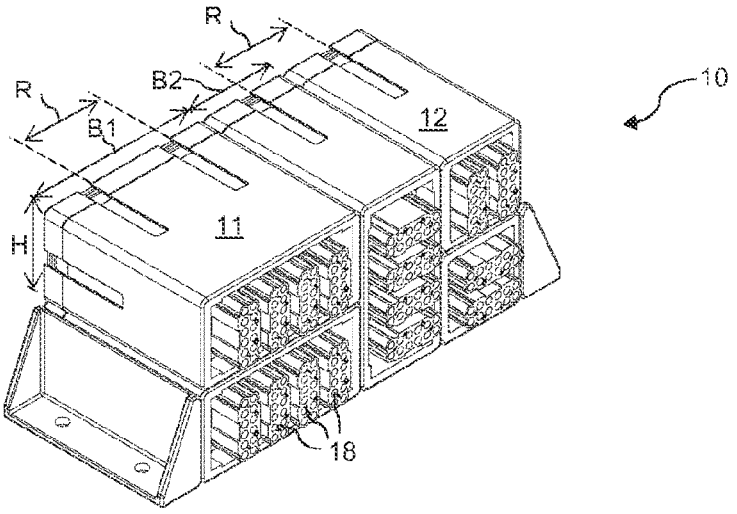
FIG. 1 shows a perspective view of a plug connector unit by way of example which is made up of a plurality of housing frames of a first and a second type.
Figure 2:
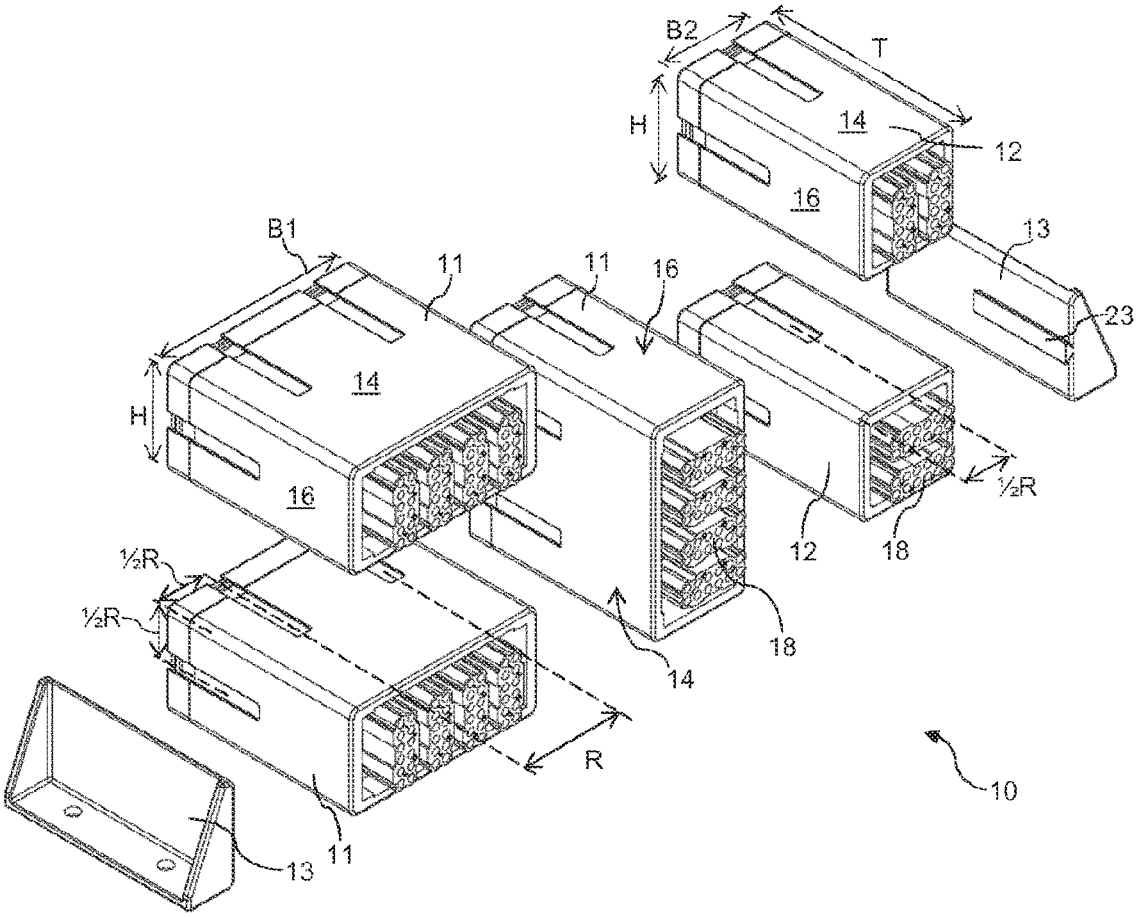
FIG. 2 shows an exploded view of FIG. 1.

FIGS. 1-2 show a plug connector unit 10 which is configured purely by way of example of the rectangular plug connector type, which is made up of first housing frames 11 and second housing frames 12 as well as two lateral mounting flanges 13. Just two types of housing frames 11, 12 already afford a high level of modularity in the structure of the plug connector unit 10.

Each of the housing frames 11, 12 is in the form of a hollow frame with four side walls 14, 16 which are arranged in a square configuration and which are at a right angle to each other, and open at the front and rear sides. Plugging connection is effected at the front side in the assembly plane (plane perpendicular to FIG. 5) to a further plug connector unit (not shown). Two parallel side walls 14 define the frame width B1 and B2 of the housing frame 11 and 12 respectively and the other two parallel side walls 16 define the frame height H of the housing frame. The perpendicular directions in which the frame width B and frame height H extend define the assembly plane perpendicularly to the depth T of the housing frame 11, 12.

In both housing frames 11, 12 the frame width B1, B2 is substantially N-times the frame height H with N being a whole number. In mathematical terms B1, B2 and H are congruent with respect to the selected smallest dimension unit, here H. In the first housing frame 11 the frame width B1 is technically exactly 2-times the frame height H plus a slight predetermined joint play of a few tenths of millimeter to facilitate assembly. In the second housing frame 12 the frame width B2 is technically identical (excluding manufacturing tolerance) to the frame height H, here no joint play is to be provided. The frame height H in that case represents the base unit or smallest unit in regard to dimensioning and is identical in both housing frames 11, 12.

FIGS. 1 through 5 show further, by way of example, in relation to each housing frame 11, 12 connecting elements 20 which are suitable for modular assembly and which are provided on the outside in all four side walls 12. Here there are provided grooves for making the positively locking connection, as the connecting elements 20. In principle a respective connecting element 29 of a side wall 14 or 16 respectively corresponds to an associated connecting element of a side wall 16 or 14 perpendicular thereto so that the two fit together or can cooperate, possibly with the use of a separate connector portion. In the example in FIGS. 1 through 5 all grooves as the connecting elements are identical.

The connecting elements 20 are arranged relative to each other in accordance with a grid dimension R along the periphery or both directions of the width B1, B2 and the height, in such a way that a plurality of housing frames 11, 12 can be connected together by means of their connecting elements in a modular structure and in each of four spatial orientations or at each side wall 14, 16. Thus the user can use the housing frames 11, 12 as components of a modular system to form a plug connector unit of virtually any configuration. The further attachment portions like for example the mounting flanges 13 can be provided with connectors 23 for the modular structure.

In the first housing frame 11, in the illustrated embodiment two connecting elements 20 are provided at the grid distance R at the longitudinal side walls 14 respectively. A respective connecting element 20 is fitted or incorporated in the narrow sides 16 exactly centrally. In this case the connecting elements 20 are at the distance of half the grid distance, that is to say ½ R, relative to the boundary surface of the perpendicularly adjoining side wall 14, 16 respectively. It is not shown but it is possible to provide a larger number of modularly arranged connecting elements 20 at each side wall 14, 16, for example with a smaller grid distance or in the case of larger housing frames 11, 12. The longitudinal side walls have a number m×n of connecting elements 20, preferably with m being even, wherein n corresponds to the number of connecting elements 20 at the narrow side walls. The integral value m corresponds in that case to the dimensional ratio B1:H or B1:B2 respectively (as B1=H).

By suitably adapted dimensioning of the side walls 14, 16 with dimensions B1, B2, modulo H (possibly plus play) in combination with the connecting elements 20 which are arranged modular-like or grid-like the modular principle or the modularity is implemented for assembly of the housing frames 11, 12, as shown in an example in FIG. 2. In this case all four side walls 14, 16 can be respectively used for connection or assembly so that the configuration in both directions of extent of the assembly plane can be freely selected, with any overall width modulo H and any overall height modulo H (with H or B2 as the smallest unit).

Figure 3A:
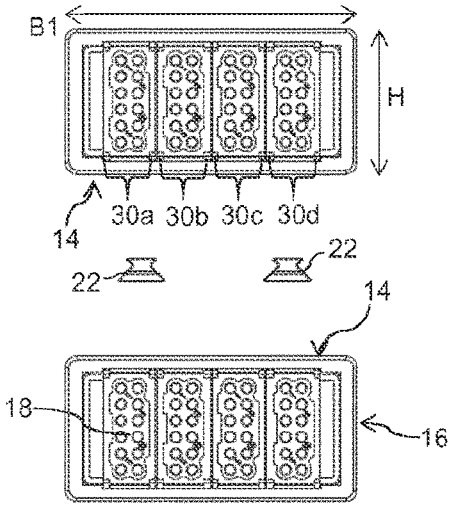
FIGS. 3A-3B show a front view (FIG. 3A) to illustrate the fixing of two housing frames to each other by means of tongue-and-groove connecting elements and a perspective view (FIG. 3B) of a connecting tongue suitable for same.
Figure 3B:
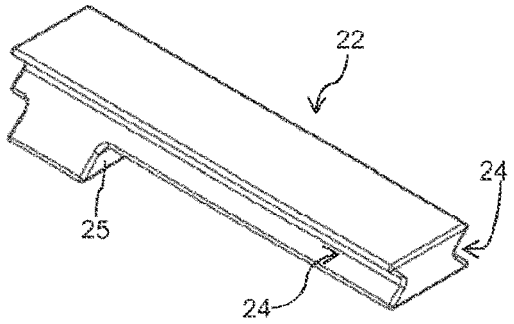
Figure 4:
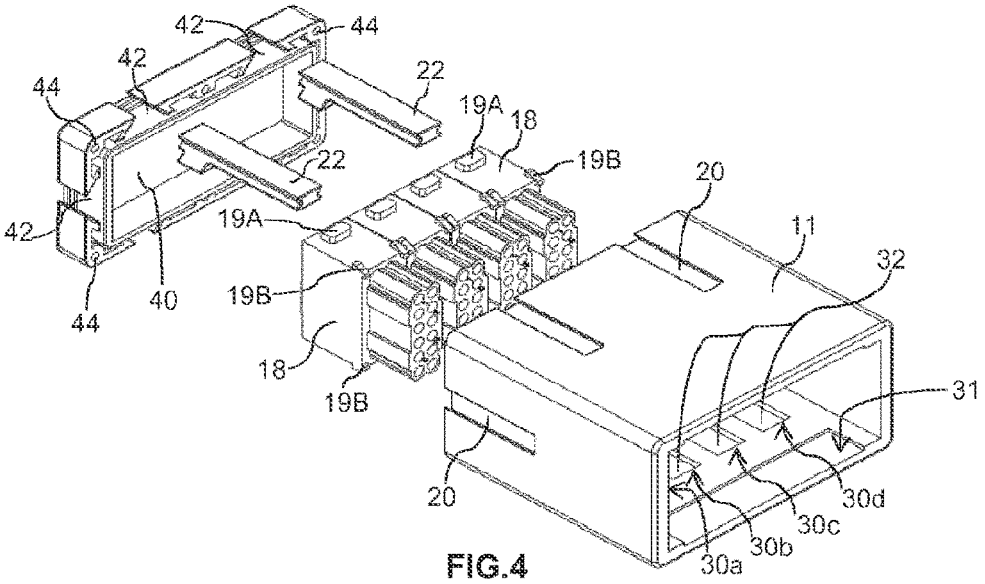
FIG. 4 shows an exploded view to illustrate the structure of a housing frame of the first type.
Figure 5:
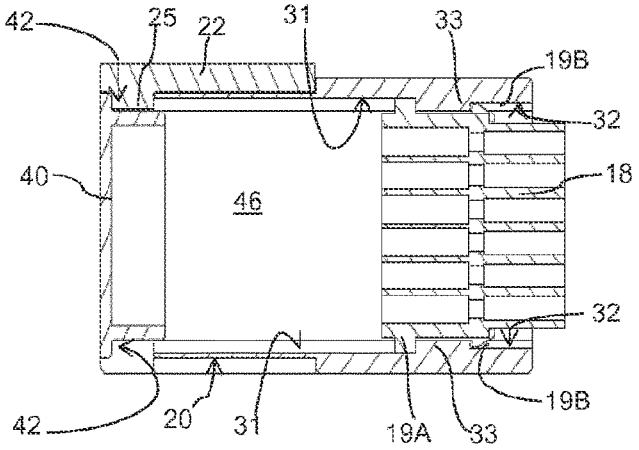
FIG. 5 shows a longitudinal sectional view along the depth of a housing frame of the first or second type.

The connecting procedure which is not shown in greater detail in FIGS. 1 and 2 is illustrated in FIGS. 3 through 5. The connecting elements 20 always extend parallel in the direction of the depth T or in the plugging direction of the plug connector unit 10 and are in the form of grooves for a dovetail connection or tongue-and-groove joint. For fixing two housing frames 11, 12 there are a suitable number of connecting tongues 22 which in cross-section respectively fit in positively locking relationship half into the groove-like connecting elements 20 in the side walls 14, 16 so that the other half is received in the oppositely disposed groove or connecting element 20 of the housing frame 11, 12 to be connected. The connecting tongues 22 are accordingly in the form of elongate shaped pins or assembly pins of an approximately |><|-shaped cross-section. Accordingly, the connecting tongues 22 have on both sides oppositely disposed parallel approximately V-shaped constrictions 24 in the longitudinal direction, behind which engage the dovetail shape of the cross-section of the connecting elements 20 (not shown) to provide the positively locking connection.

The connecting tongues 22 are secured to prevent displacement in the depth direction. That is effected on the one hand by a rear-side cover 40 or closure and on the other hand by the configuration in the manner of a blind hole of the grooves which serve as connecting elements 20 and extend from the rear end over about 40% of the depth and end within the respective side wall 14, 16, that is to say they do not extend continuously over the entire depth. For locking purposes by means of the cover 40 provided at one side of the connecting tongue 22 is an arresting projection 25 which is fixed in a corresponding receiving means 42 with play in the cover. Fixing of the cover can be effected for example by means of screw connection by means of corresponding holes 44 with the edges of the housing frames 11, 12. A peripherally extending seal (not shown) can be provided at the inside of the cover 40 for the end edges of the side walls 14, 16. The most widely varying cable inlet means (not shown) can be provided in the wall of the cover 40. For that purpose and for the actual lines, a suitable free space 46 is provided in the interior of the housing frames 11, 12.

FIGS. 3 through 5 show a plurality of identical receiving means, for example four receiving means 30*a*, 30*b*, 30*c*, 30*d* in the first housing frame 11 for a respective plug connector module 18 in the interior of the housing frame 11. (FIGS. 1 through 5 for reasons of illustration in the drawing only always show the same plug connector module 18, in which respect naturally in practice a multiplicity of per se known different plug connector modules 18 are used.). All plug connector modules 18 in this case have for example identically arranged fixing interfaces at their narrow sides externally on the plastic insulating bodies. Those modular fixing interfaces are intended for latching with previously known holding frames (not shown) and can include for example a plurality of latching projections 19A, 19B, latching hooks or the like. Provided in each receiving means 30*a*, 30*b*, 30*c*, 30*d* of the two housing frames 11, 12 are means for producing the positively locking fixing action, that are respectively compatible with the fixing interface of the plug connector module 18. FIG. 5 shows for example first and second positively locking recesses 31, 32 with an interposed latching projection 33. The positively locking recesses 31, 32 which here are rectangular are disposed in parallel opposite relationship and are provided in the inside wall of the side walls 14, 16 extending in the width-wise direction. The first positively locking recesses 31 open at the rear outwardly to facilitate insertion of the plug connector module 18, the front-side latching hooks 19B of which engage into the second positively locking recess 32 and are secured by the latching projection 33 to prevent displacement in the plugging direction. The plug connector modules 18 are arrested directly in the housing frame 11, 12 to prevent displacement in opposite relationship to the plugging direction by the positively locking recesses 31, 32, being suitably oriented and releasably connected to the housing frame. The number of receiving means 30*a*, 30*b*, 30*c*, 30*d* is preferably an even number in both housing frames 11, 12.

All components of the modular system, in particular the housing frames 11, 12, can be inexpensively produced from plastic, in which respect a technical plastic with a high level of flexural strength, in particular fiber-reinforced plastic, is preferred for the purposes of stiffness in relation to twisting. Further components of the system like assembly parts with various locking means for the plug connector unit 10, assembly plates for attachment to items of equipment or machines and so forth are not shown but will be apparent to the man skilled in the art.

The example shown in FIGS. 1 through 5 only illustrates two basic types of housing frames 11, 12, in which respect the housing can naturally be further scaled, for example with a third type of housing frame which is "doubled up" in comparison with the first housing frame, of a square cross-section with double the height 2H and the same width B1 and so forth. All housing frames in that case are modularly compatible with each other and can be combined in any desired way.

By means of the modular system which is enlarged according to the invention by a further level of modularity it is possible to quickly, easily and inexpensively manufacture all conceivable geometries which are variable with few types of housing frames 11, 12.

The plug connector units 10 which are constructed in that way can be used in all fields, in particular in industrial applications, for example as a central plug unit for the supply and control of a machine, as a separating means between relatively moveable parts, for example on connecting elements for an energy guide chain, on switch cabinets and other items of equipment and so forth.

Figure 7A:
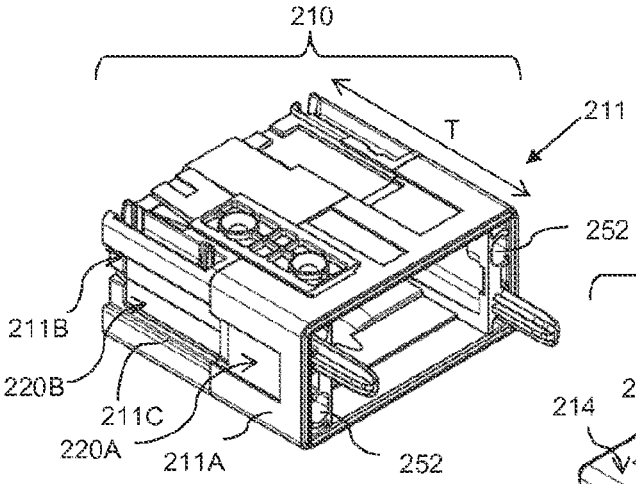
Figure 7B:
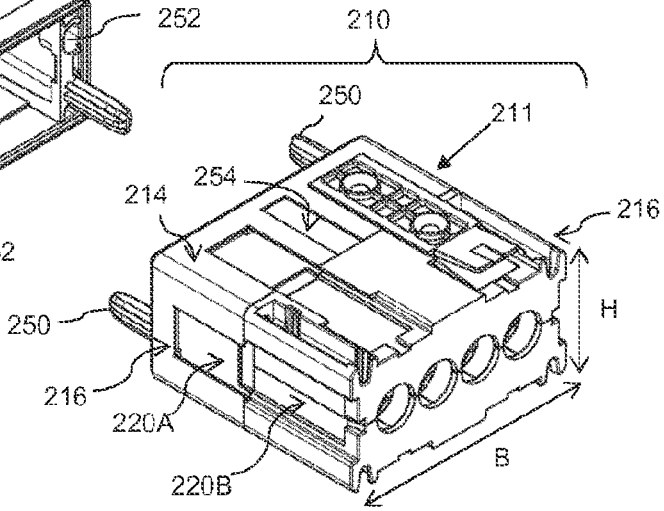
Figure 8:
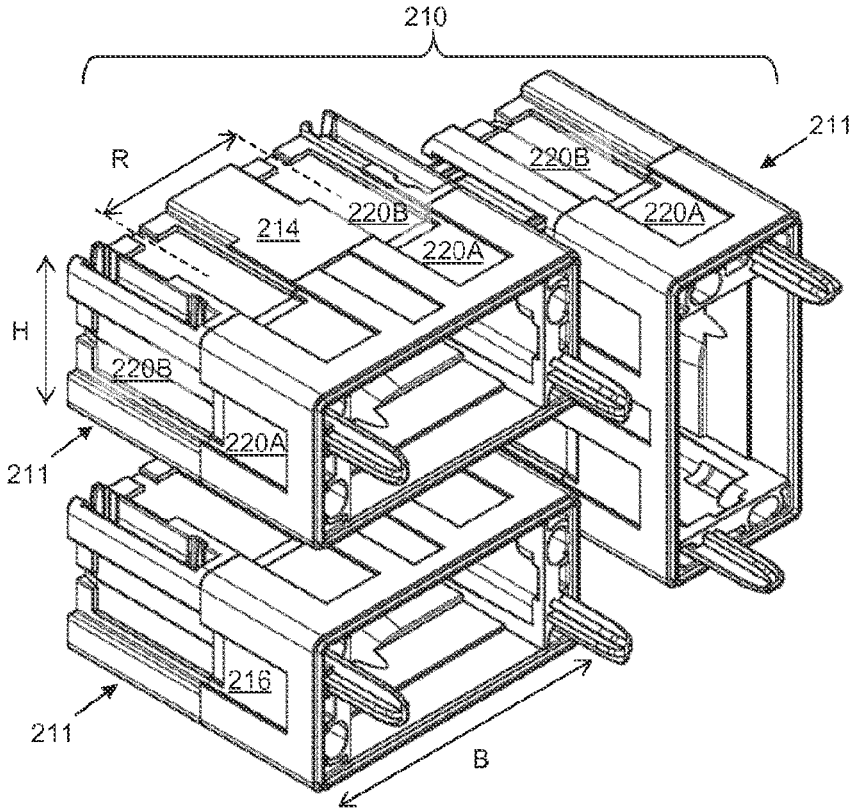
FIG. 8 shows a perspective view of a plug connector unit by way of example comprising housing frames as shown in FIGS. 6-7A, 7B.

FIGS. 6 through 9 show a second preferred embodiment of a housing frame 211 according to the invention for the construction of plug connector units 210 or a plug assembly (FIG. 8). An essential difference in relation to the first embodiment is that the housing frame 211 is made up from substantially three separately produced shaped parts, for example using metal pressure die casting or plastic die casting.

Figure 6:
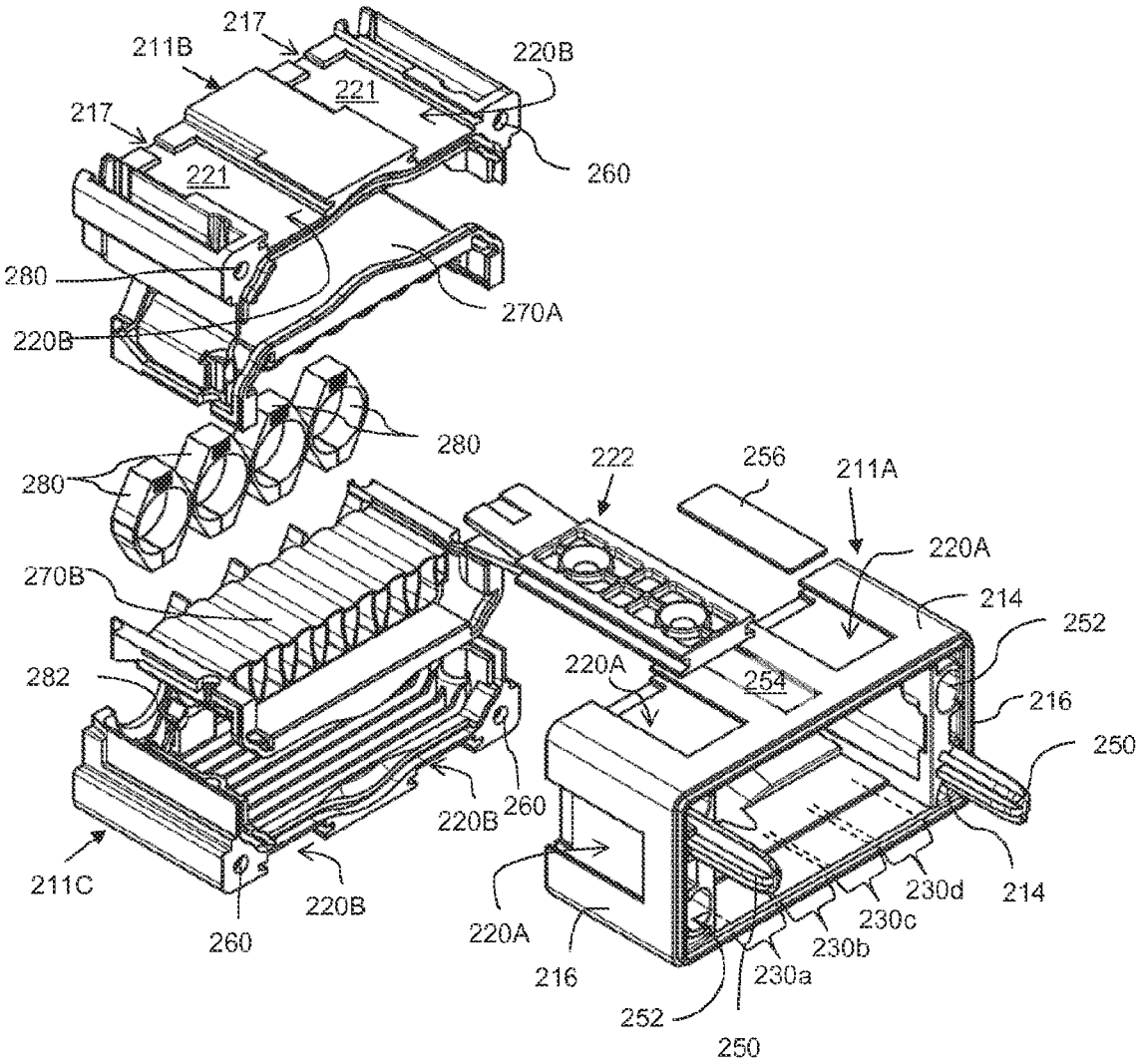
Figure 9:
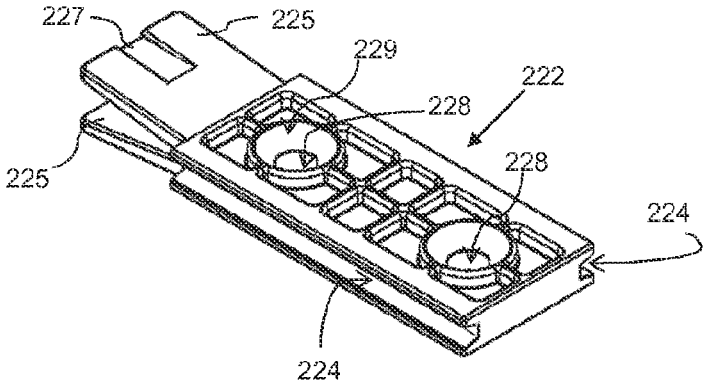
FIG. 9 shows a perspective view of a connecting tongue for making the tongue-and-groove connection of housing frames as shown in FIGS. 6-7A, 7B.

FIG. 6 shows the three main components: a frame-shaped front part 211A which forms the plug side of the housing frame 211, and two rear parts 211B, 211C which are to be assembled perpendicularly to the plugging direction or depth T and which form the part, that is remote from the plug side, of the finished housing frame 211 (see FIGS. 7A and 7B).

Provided in the interior of the frame-like front part 211A—similarly to FIGS. 3 through 5—is a number of receiving regions 230*a*-230*d* for a respective plug connector module 18 (not shown here) so that per se known plug connector modules 18 can be mounted in the front part 211A. In the example shown in FIGS. 6 through 9 a separate holding frame (not shown) for the plug connector modules 18 is mounted in the front part 211A. It is possible to use for example a holding frame as shown in FIG. 4 of EP 2 537 212 B1, the teaching thereof in this respect is hereby incorporated herein. Such a holding frame forms a respective receiving means in each of the receiving regions 230*a*-230*d*. Provided at the end and inwardly on the side walls 216 which predetermine the frame height H in mirror-reversed relationship is a respective pair comprising a centering projection 250 and a corresponding centering receiving means 252. The centering projections 250 and associated centering receiving means 252 facilitate production of the plug connection comprising two plug connector units 210 which respectively form plugs and counterpart plugs (see FIGS. 7A-7B). In addition, a receiving means 254 for a label plate 256 can be respectively provided at both sides on the large side walls 214 of the front part 211 in a central position.

Provided at the outside on all side walls 214, 216 of the front part 211A are first connecting grooves 220A which extend according to the invention in accordance with the grid dimension R in the direction of the depth T. Here too therefore a plurality of housing frames 211 can be connected together by means of their connecting elements in modular relationship and in each of four spatial orientations or at each side wall 214, 216 (see FIG. 8).

The first connecting grooves 220A jointly cooperate with aligned second connecting grooves 220B at both rear parts 211B, 211C with a connecting tongue (FIG. 9) to produce a tongue-and-groove connection between two or more housing frames 211.

Furthermore provided at least in the second connecting grooves 220B of the rear parts 211B, 211C is a latching recess 221 forming a rearward latching edge in order to permit latching engagement of a respective one of two latching tongues 25, of mirror-image symmetrical relationship, of the connecting tongues (see FIG. 9) in the plugging direction or the direction of the depth T. The connecting tongue 222 is shown in greater detail in FIG. 9. At one end it includes the two latching tongues 225 of mirror-image symmetrical configuration. The latching tongues 225 respectively have centrally on the outside a recess 227 which in the assembled arrangement aligns with a corresponding recess 217 in the rear parts 211B, 211C and permits release of the latching tongues for example by means of a flat screwdriver. In addition, provided in the main body of the connecting tongues 222 are two continuous screw holes 228 which at least at one side can have a head countersink 229. The screw holes 228 permit fixing of the plug connector unit 210 to any desired surfaces, for example in a switch cabinet or on a mounting plate.

In addition, similarly to the first embodiment, for making the tongue-and-groove connection, the connecting tongue 222 has constrictions 224 which are arranged in opposite relationship on both sides and which are of an approximately V-shape cross-section. The constrictions 224 cooperate with the longitudinal edges of the grooves 220A, 220B and allow a robust connection of two oppositely disposed housing frames 211 (see FIG. 8).

For fixing the rear parts 211B, 211C to the front part 211A there are respective screw holes at the corners on the rear parts 211B, 211C and threads (not shown) on the front part 211A. Perpendicularly to the plugging direction the two rear parts 211B, 211C can also be fixed to each other by screw connections or other suitable fixed connection. A strain relief device can be provided in the interior between the rear parts 211B, 211C.

In the example shown in FIG. 6 the strain relief device includes an upper strain relief portion 270A and a lower strain relief portion 270B which can be of the same structure. The strain relief portions 270A, 270B can have elastically deformable, honeycomb-like regions based on the principle of Utility Model DE 20 2017 101 483 U1. After connection of the upper rear part 211B to the lower rear part 211C the strain relief portions 270A, 270B produce a clamping force on cables which are to be respectively connected to the plug connector modules (not shown). A high clamping force however is not required as, with a suitable configuration of the strain relief portions 270A, 270B, sufficient strain relief can already be achieved by surface adhesion in a suitable pairing of plastic material.

In addition, provided at the rear side of the rear parts 211B, 211C are recesses matching cable pass-through support sleeves 280 for passing through the lines or cables (not shown). Preferably slotted cable pass-through support sleeves 280 of approximately rhomboidal cross-section are used so that, upon connection of the rear parts 211B, 211C, a further clamping action can also be achieved on the line by way of suitable inclined run-on surfaces 282 by virtue of the shaping of the side parts, that are at an acute angle relative to each other, of the cable pass-through support sleeves 280, besides the sealing effect. Shown here by way of example are four exits for lines, wherein fewer than four cable exits and/or different exit diameters are also possible.

Besides the cable pass-through support sleeves 280 suitable seals are further respectively provided between the main parts of the housing frame 211, that is to say the front part 211A and the two rear parts 211B, 211C. In the example shown here (FIG. 6) the seals are for example produced integrally in the strain relief portions 270A, 270B. It is also possible to provide separate seals between the front part 211A and the two rear parts 211B, 211C. The plug connector unit 210 is sealed off at least in relation to water drops and possibly spray water, by means of the seals. Preferably the plug connector units 210 are resistant to spray water and are possibly resistant to jet water. A peripheral seal (not shown) can also be provided at the plug side at the front of the front part 211A.

FIGS. 7A-7B illustrate the cooperation of two plug connector units 210 in the form of a plug and a counterpart plug (here by way of example without a plug connector module and with only one respective connecting tongue 222).

FIG. 8 shows by way of example an arrangement with three plug connector units 210 which are connected together to form a plug assembly. When using such a plug assembly comprising plug connector units 210 non-interchangeability is inherently also improved in relation to conventional plug connectors. Plugs and counterpart plugs in the case of a plug assembly which is suitably composed of plug connector units 210 are inherently non-rotatable and/or non-interchangeable.

LIST OF REFERENCES

FIGS. 1 through 3:
B1, B2 width
H height
R grid dimension or grid distance
T depth
10 plug connector unit
11 housing frame (first type)
12 housing frame (second type)
13 mounting parts
14 side walls (width)
16 side walls (height)
18 plug connector module
19A, 19B latching projections
20 connecting element
22 connecting tongue

23 connecting tongue
24 constriction
25 arresting projection
30*a*,30*b*, 30*c*, 30*d* receiving means (for plug connector module)
31, 32 positively locking recesses
33 latching projection
FIGS. 4 and 5:
40 cover
42 receiving means (for arresting projection)
44 holes (for screws)
46 free space
FIGS. 6 through 9:
B width
H height
R grid dimension or grid distance
T depth
210 plug connector unit
211 housing frame
211A front part (of the housing frame)
211B, 211C rear parts (of the housing frame)
214 side wall (width)
216 side wall (height)
217 recess
220A first connecting groove
220B second connecting groove
221 latching recess
222 connecting tongue
224 constriction
225 latching tongues
227 recess
228 screw holes
229 screw head countersink
230*a*, 230*b*, 230*c*, 230*d* receiving means (for plug connector module)
250 centering projection
252 centering receiving means
254 receiving means (for label plate)
256 label plate
260 screw holes (of the rear parts)
270A, 270B elastic strain relief portion
280 cable pass-through support sleeves
282 inclined run-on surfaces

What is claimed is:

1. A modular system for plug connector modules for producing rectangular plug connectors, including a plug connector unit and a further plug connector unit, namely a plug and a counterpart plug, the plug and the counterpart plug respectively including at least one first housing frame having a plurality of plug connector modules for lines, wherein the plug connector modules are respectively received in one of a plurality of identical receiving means in the interior of the housing frame, wherein the plug connector units as the plug and the counterpart plug cooperate for plugging connection of the plug connector modules, wherein the housing frame has two parallel longitudinal side walls, which define the frame width of the housing frame and perpendicularly thereto two parallel narrow side walls which define the frame height of the housing frame, wherein the frame width is an integral multiple of the frame height, preferably plus joint play;

the longitudinal side walls and the narrow side walls have connecting elements, in particular for positively locking connection, wherein a respective connecting element of a longitudinal side wall corresponds to a connecting element of a narrow side wall; and a plurality of connecting elements are arranged along the frame width at a grid distance which corresponds to the frame height, preferably plus joint play, at each longitudinal side wall, so that a plurality of housing frames can be modularly connected together by means of their connecting elements.

2. The modular system as set forth in claim 1, wherein all connecting elements are provided for positively locking connection externally on the longitudinal and narrow side walls respectively and/or all connecting elements are of an identical or complementary configuration.

3. The modular system as set forth in claim 2, wherein at least a part of the connecting elements are in the form of grooves extending in the direction of the depth of the housing frame for a tongue-and-groove connection.

4. The modular system as set forth in claim 3, wherein there are provided separate connecting elements cooperating with the connecting elements of the housing frames, in the form of separate connecting tongues for tongue-and-groove connection, wherein the connecting elements are of a cross-sectional configuration for a dovetail connection.

5. The modular system as set forth in claim 4, wherein the separate connecting elements cooperate at least in positively locking relationship with the connecting elements of the housing frames and have two latching tongues of mirror-image symmetrical configuration for latching engagement with the housing frames and/or two screw holes, with a screw head countersink.

6. The modular system as set forth in claim 1, wherein each housing frame is of a multi-part composition, being composed of three main parts, wherein the housing frame is composed of a frame-form front part in which a plurality of plug connector modules are or can be received, and two cooperating shell-like rear parts which can be connected together and to the front part.

7. The modular system as set forth in claim 1, wherein arranged in the housing frame is a holding frame having receiving means for plug connector modules; or provided at both inward sides of the longitudinal side walls in each receiving means are respective oppositely disposed first and second positively locking recesses which for latching purposes cooperate with counterpart means of a plug connector module so that same is arrested and oriented in the housing frame.

8. The modular system as set forth in claim 1, wherein provided at the rear side of the housing frame are a plurality of cable pass-through openings, wherein provided in the housing frame in the direction of the depth between the cable pass-through openings and the receiving means is an elastic strain relief device.

9. The modular system as set forth in claim 1, wherein the plug connector units are respectively composed of a plurality of housing frames and respectively cooperate, without a further housing surrounding the housing frames, for plugging connection of the plug connector modules.

10. The modular system as set forth in claim 1, wherein at least some housing frames are made of plastic, using the injection molding process, and/or metal, with aluminum or zinc, using the pressure die casting process.

11. The modular system as set forth in claim 1, wherein there are provided separate mounting parts, in particular mounting flanges, angle members and/or mounting plates, which cooperate with the connecting elements, in particular of the narrow side walls, to fix the one plug connector unit to the respective connecting location like a machine part, switch cabinet or the like.

12. The modular system as set forth in claim 11, wherein provided on the housing frames are fixable locking portions for securing two connected plug connector units, in particular on the connecting elements of the side walls and/or on mounting parts.

13. The modular system as set forth in claim 1, wherein each first housing frame has an even number of 2n identical receiving means, in particular four, six or eight receiving means for fixing plug connector modules.

14. The modular system as set forth in claim 1, wherein in each of the plug connector units there is provided at least one second housing frame having at least two identical receiving means for fixing a plurality of plug connector modules in the interior of the housing frame, wherein the housing frame has two parallel side walls which define the width of the housing frame and perpendicular thereto two parallel side walls which define the frame height of the housing frame, and the frame width is equal to the frame height, which is in particular identical to the frame height of the first housing frame; and the side walls have connecting elements, in particular for positively locking connection, wherein a connecting element of a side wall corresponds respectively to a connecting element of the adjoining side wall so that a plurality of second housing frames can be modularly connected by means of their connecting elements to each other and/or to a first housing frame to form the respective plug connector unit.

15. The modular system as set forth in claim 1, wherein a number of different plug connector modules for different transmission media can be combined in each plug connector unit.

16. A rectangular plug connector for lines, in particular electric lines and/or for different transmission media, including a housing frame comprising a plurality of identical receiving means for a respective plug connector module in the interior of the housing frame, wherein the housing frame has two parallel side walls which define the width of the housing frame and perpendicularly thereto two parallel side walls which define the height of the housing frame, wherein the housing frame has a front part for receiving the plug connector modules, having a front side at which a plug connection of the plug connector modules can be made, wherein fixed to a rear side is a rear-side closure, in particular a rear part or a cover, which is dimensioned in matching relationship with the housing frame, wherein the frame width is substantially N-times the frame height, with N being a whole number;

the side walls have connecting elements, in particular for positively locking connection, wherein a respective connecting element of a side wall corresponds to a connecting element of a side wall perpendicular thereto; and the connecting elements are arranged relative to each other in accordance with a grid distance in such a way that a plurality of housing frames can be modularly connected together by means of their connecting elements to form a plug connector unit, all connecting elements are of an identical or complementary configuration, at least a part of the connecting elements are in the form of grooves extending in the direction of the depth of the housing frame for a tongue-and-groove connection, wherein the front part has first connecting grooves and the rear-side closure has second connecting grooves, and the rectangular connector has at least two housing frames which are fixed to each other by means of their connecting elements and are connected to provide the rectangular connector, wherein the first connecting grooves cooperate with the aligned second connecting grooves to produce a tongue-and-groove connection between the at least two housing frames.

17. The rectangular connector as set forth in claim 16 comprising the separate connecting elements cooperating with the connecting elements of the housing frames, in the form of separate connecting tongues for tongue-and-groove connection, wherein the connecting elements are of a cross-sectional configuration for a dovetail connection.

18. The rectangular connector as set forth in claim 16, wherein the housing frame is in one piece.

19. The plug connector unit including a plurality of plug connector modules for lines, comprising at least two housing frames as set forth in claim 16, wherein the plug connector modules are respectively received in one of the housing frames and the housing frames are fixed to each other by means of their connecting elements and are connected to provide the plug connector unit.

20. A rectangular plug connector produced from a modular system, comprising:

a plurality of plug connector modules for lines; and at least one first housing frame having a plurality of identical receiving means for receiving the plurality of plug connector modules in an interior of the housing frame, wherein the plug connector modules are respectively received in the housing frame and wherein the housing frame has two parallel longitudinal side walls, which define a frame width of the housing frame and perpendicularly thereto two parallel narrow side walls which define a frame height of the housing frame;

wherein the frame width is substantially N-times the frame height, with N being a whole number;

wherein the longitudinal side walls and the narrow side walls have connecting elements, in particular for positively locking connection, wherein a respective connecting element of a longitudinal side wall corresponds to a connecting element of a narrow side wall; and a plurality of the connecting elements are arranged along the frame width at a grid distance which corresponds to the frame height at each longitudinal side wall, so that a plurality of housing frames are modularly connectable together by their connecting elements to form the rectangular connector.

21. The rectangular plug connector as set forth in claim 20, wherein all the connecting elements are provided for positively locking connection externally on the longitudinal and the narrow side walls respectively and/or all the connecting elements are of an identical or a complementary configuration.

22. The rectangular plug connector as set forth in claim 21, wherein at least a part of the connecting elements are in a form of grooves extending in a direction of a depth of the housing frame for a tongue-and-groove connection.

23. The rectangular plug connector as set forth in claim 22, further comprising separate connecting elements which cooperate with the connecting elements of the housing frames, in particular in a form of separate connecting tongues for the tongue-and-groove connection.

24. The rectangular plug connector as set forth in claim 23, wherein the connecting elements are of a cross-sectional configuration for a dovetail connection.

25. The rectangular plug connector as set forth in claim 23, wherein the separate connecting elements cooperate at least in positively locking relationship with the connecting elements of the housing frames.

26. The rectangular plug connector as set forth in claim 25, wherein the separate connecting elements have two latching tongues of mirror-image symmetrical configuration for engagement with the housing frames and/or two screw holes.

27. The rectangular plug connector as set forth in claim 20, wherein the housing frame is of a multi-part composition.

28. The rectangular plug connector as set forth in claim 27, wherein the housing frame comprises a frame-form front part in which the plurality of plug connector modules are received, and two cooperating shell-like rear parts which are connectable together and to the front part.

29. The rectangular plug connector as set forth in claim 20, wherein arranged in the housing frame is a holding frame having receiving means for the plug connector modules; or provided at both inward sides of the longitudinal side walls in each receiving means are respective oppositely disposed first and second positively locking recesses which for latching purposes cooperate with counterpart means of a plug connector module so that same is arrested and oriented in the housing frame.

30. The rectangular plug connector as set forth in claim 20, wherein provided at a rear side of the housing frame are a plurality of cable pass-through openings, and wherein provided in the housing frame in a direction of a depth between the cable pass-through openings and the receiving means is an elastic strain relief device.

31. The rectangular plug connector as set forth in claim 20, wherein the rectangular plug connector is composed of the plurality of housing frames, and, in each case, without a further housing surrounding the housing frames, cooperate with a further rectangular plug connector composed of housing frames for plugging connection of the plug connector modules.

32. The rectangular plug connector as set forth in claim 20, wherein the rectangular plug connector is composed of the plurality of housing frames, wherein at least some housing frames are made of plastic and/or metal.

33. The rectangular plug connector as set forth in claim 20, wherein there are provided separate mounting parts, in particular mounting flanges, angle members and/or mounting plates, which cooperate with the connecting elements, in particular of the narrow side walls, to fix the rectangular plug connector.

34. The rectangular plug connector as set forth in claim 33, wherein provided on the housing frames are fixable locking portions for securing two connected rectangular plug connectors, in particular on the connecting elements of the side walls and/or on the mounting parts.

35. The rectangular plug connector as set forth in claim 20, wherein the first housing frame has an even number of 2n identical receiving means, in particular four, six or eight receiving means for fixing the plug connector modules.

36. The rectangular plug connector as set forth in claim 20, wherein there is provided at least one second housing frame having a plurality of identical receiving means for receiving a plurality of plug connector modules in an interior of the housing frame, wherein the housing frame has two parallel side walls which define a frame width of the housing frame and perpendicular thereto two parallel narrow side walls which define a frame height of the housing frame;

wherein the frame width is equal to the frame height, which is in particular identical to the frame height of the first housing frame; and wherein the side walls have connecting elements, in particular for positively locking connection, wherein a connecting element of a side wall corresponds respectively to a connecting element of the adjoining side wall so that a plurality of second housing frames are modularly connectable by their connecting elements to each other and/or to the first housing frame to form the rectangular plug connector.

37. The rectangular plug connector as set forth in claim 20, wherein the housing frame is in one piece.

38. The rectangular plug connector as set forth in claim 20, wherein a number of different plug connector modules for different transmission media are combined in the rectangular plug connector.

* * * * *